US009874175B2

(12) United States Patent
Rislå et al.

(10) Patent No.: US 9,874,175 B2
(45) Date of Patent: Jan. 23, 2018

(54) EXTERNAL HEAT ENGINE DEVICE

(71) Applicant: Viking Heat Engines AS, Kristiansand (NO)

(72) Inventors: Harald Nes Rislå, Lillesand (NO); Christian Schlüter, Iserlohn (DE); Moritz Becker, Remscheid (DE); Andreas Mück, Bergisch Gladbach (DE)

(73) Assignee: Viking Heat Engines AS, Kristiansand (NO)

( * ) Notice: Subject to any disclaimer, the term of this patent is extended or adjusted under 35 U.S.C. 154(b) by 86 days.

(21) Appl. No.: 15/026,382

(22) PCT Filed: Oct. 7, 2014

(86) PCT No.: PCT/NO2014/050187
§ 371 (c)(1),
(2) Date: Mar. 31, 2016

(87) PCT Pub. No.: WO2015/057077
PCT Pub. Date: Apr. 23, 2015

(65) Prior Publication Data

US 2016/0245225 A1 Aug. 25, 2016

(30) Foreign Application Priority Data

Oct. 17, 2013 (NO) ..... 20131378

(51) Int. Cl.
*F02G 1/043* (2006.01)
*F02G 3/02* (2006.01)
(Continued)

(52) U.S. Cl.
CPC ..... *F02G 1/044* (2013.01); *F01K 25/08* (2013.01); *F01L 1/026* (2013.01); *F02G 1/043* (2013.01); *F02G 3/02* (2013.01)

(58) Field of Classification Search
CPC .. F02G 1/044; F02G 3/02; F02G 1/043; F01L 1/026; F01K 25/08
(Continued)

(56) References Cited

U.S. PATENT DOCUMENTS 4,428,197 A 1/1984 Liljequist
4,453,527 A 6/1984 Wade
(Continued)

FOREIGN PATENT DOCUMENTS

DE 10100714 7/2002
EP 0124433 11/1984
(Continued)

OTHER PUBLICATIONS

Written Opinion, PCT/NO2014/050187, dated Jun. 29, 2015.
(Continued)

*Primary Examiner* — Hoang Nguyen
(74) *Attorney, Agent, or Firm* — Andrus Intellectual Property Law, LLP

(57) ABSTRACT

An external-heat engine device working on a Rankine cycle, and preferably an organic Rankine cycle. The external-heat engine, which is designed to give operational advantages, includes a cylinder block, a top cover and a bottom tray with sealing surfaces arranged to be joined together and to rest against complementarily fitting covers, each sealing surface resting sealingly against only one opposite sealing surface.

10 Claims, 4 Drawing Sheets

(51) Int. Cl.

| | |
|---|---|
| ***F02G 1/044*** | (2006.01) |
| ***F01K 25/08*** | (2006.01) |
| ***F01L 1/02*** | (2006.01) |

(58) Field of Classification Search
USPC ..... 60/508–515, 517–526
See application file for complete search history.

(56) References Cited

U.S. PATENT DOCUMENTS

| | | | | |
|---|---|---|---|---|
| 6,279,522 | B1 * | 8/2001 | Balzar | F01L 1/02 123/90.1 |
| 6,536,207 | B1 | 3/2003 | Kamen et al. | |
| 8,590,302 | B2 * | 11/2013 | Risla Nes | F02G 1/043 60/521 |
| 2002/0185093 | A1 * | 12/2002 | Immel | F01L 1/024 123/90.31 |
| 2004/0040313 | A1 | 3/2004 | Kurokawa et al. | |
| 2005/0076869 | A1 * | 4/2005 | Utsumi | F01L 1/02 123/90.27 |
| 2011/0186009 | A1 * | 8/2011 | Phan | F02B 57/08 123/44 A |

FOREIGN PATENT DOCUMENTS

| | | |
|---|---|---|
| GB | 2051961 | 1/1981 |
| GB | 2485162 | 5/2012 |
| WO | 20110157662 | 12/2011 |
| WO | 20130109152 | 7/2013 |

OTHER PUBLICATIONS

Written Opinion, PCT/NO2014/050187, dated Dec. 11, 2015.
International Preliminary Report on Patentability, PCT/NO2014/050187, dated Sep. 29, 2015.

* cited by examiner

EXTERNAL HEAT ENGINE DEVICE

CROSS-REFERENCE TO RELATED APPLICATIONS

This application is the U.S. national stage application of International Application PCT/NO2014/050187, filed Oct. 7, 2014, which international application was published on Apr. 23, 2015, as International Publication WO 2015/057077 in the English language. The International Application claims priority of Norwegian Patent Application No. 20131378, filed Oct. 17, 2013. The international application and Norwegian application are both incorporated herein by reference, in entirety.

FIELD

This invention relates to an improved external-heat engine. More particularly, it relates to an external-heat engine device that works on a Rankine cycle, preferably an organic Rankine cycle, the external-heat engine, which is designed to give operational advantages, comprising a cylinder block and a top cover with sealing surfaces arranged to be joined to each other and to rest against complementary fitting surfaces.

BACKGROUND

In an external-heat engine, the heat source is located outside the external-heat engine, which is arranged to convert heat into mechanical energy, for example. This invention relates to an external-heat engine that works primarily on the so-called Organic Rankine Cycle (ORC). It is assumed that it may also be suitable for other external-heat engine cycles, and then in particular a conventional Rankine cycle. This process, in its simplest form, includes heating a medium in an evaporator until it takes a vapour phase under pressure. Then the vapour is carried into the external-heat engine where the pressure is reduced while the thermal energy is converted into mechanical energy. The medium is then condensed in a, relative to the external-heat engine, external condenser before it is pumped back into the evaporator.

The invention is directed towards an external-heat engine of the piston type.

External-heat engines of this kind are designed to be in continuous operation day and night for several years without any repairs and with minimal maintenance. Things such as seal design and choice of driving lines have turned out to be critical to achieving a sufficiently long life.

The driving lines used the most for valves in conventional piston engines usually include chain or toothed-belt operation. Known driving lines of this kind do not have sufficiently long lives for use in an external-heat engine.

However, it has turned out that a geared drive, even with its negative characteristics such as noise and vibration transmission, constitutes a usable solution. The reason is a substantially longer life under suitable conditions. Correct dimensioning and good lubrication are critical in that respect.

SUMMARY

The invention has for its object to remedy or reduce at least one of the drawbacks of the prior art.

The object is achieved according to the invention through the features that are specified in the description below and in the claims that follow.

According to the invention, an external-heat engine that works on a Rankine cycle, and preferably an organic Rankine cycle, is provided, wherein the external-heat engine, which is designed to give operational advantages, includes a cylinder block, a top cover and a bottom tray with sealing surfaces arranged to be joined together and to rest against complementarily fitting cover surfaces, the external-heat engine being characterized by each sealing surface resting sealingly against only one opposite sealing surface.

By operational advantages are meant, in this connection, longer operation time between faults and longer operation intervals between maintenance than what is usual in combustion engines, for example.

Empirically, so-called T-joints, in which the end portion of a seal is typically perpendicular to another seal, give a greater risk of faults than a sealing surface resting against only one opposite sealing surface. Many solutions that are usual in piston-based combustion engines, for example, will therefore be unsuitable for external-heat engines. The seals may include separate seals or a sealing compound between the individual machine components.

The external-heat engine may constitute a pressure-tight structure. This means that all the components forming parts of the thermodynamic engine are designed to resist a relatively high internal pressure. An overpressure of 5 bar is normally sufficient, but, under particular conditions, the external-heat engine may have to be able to resist an overpressure approaching 10 bar.

The external-heat engine is, of course, provided with an inlet and an outlet (exhaust port) for a driving medium.

The external-heat engine may be formed with an electric generator located inside the pressure-tight covers of the external-heat engine. It is thereby unnecessary to extend, for example, a crankshaft out of the external-heat engine for the generator to be operated, which substantially reduces the risk of leakages from a shaft seal.

The electric generator may comprise a rotor, which is arranged on a crankshaft in the external-heat engine.

In the external-heat engine, valves are normally arranged, which are driven by valve gears via a first intermediate gear, alternatively also a second intermediate gear. The first intermediate gear is in mesh with at least two gears, which may be valve gears and/or further intermediate gears. The first intermediate gear may be in engagement with the crankshaft gear directly or via a third intermediate gear.

By the very fact of the first intermediate gear having its gear bearing in the cylinder block and the valve gears and any further intermediate gears being arranged in the top cover, the top cover may be dismantled from the cylinder block without the gears having to be dismantled first. This is conducive to a reduced extent of work if, for example, a top-cover gasket is to be replaced. In that respect, it will be practical for the first intermediate gear to be relatively large in proportion to the gears with which it is in mesh, for example by having a diameter nearly twice as large as or larger, alternatively a tooth number at least two times larger, than theirs. To provide for this, extra room may be made for the first, large intermediate gear in the cylinder block. For example, in a case in which the cylinder block is made of a cast material, for example grey cast iron, a widened curve shape may be made in the cylinder block, adapted to the shape and size of the first, large intermediate gear, but still not larger than what is practically necessary.

At least one of the valve gears may be connected to a camshaft, and at least one of the valve gears may be connected to a rotary valve.

One of the valve gears may be connected to a valve-actuating mechanism. By a valve-actuating mechanism is meant a mechanism which, when activated, rotates one camshaft or rotary valve relative to the other camshaft, rotary valve or the crankshaft. The U.S. Pat. Nos. 5,253,622 and 6,994,067 show two different mechanical valve-actuating mechanisms.

An abundant supply of lubricant to the gears is important. Lubricant may be supplied via one of the gear attachments, for example a gear shaft, preferably via a gear in which a spreader is arranged, possibly in the form of machined grooves in the gear. Furthermore, the external-heat engine is provided with a large bottom tray (oil sump) to be able to hold a relatively large amount of lubricant, which in itself extends the interval between the lubricant changes.

Even if the seal design between the components of the external-heat engine, such as cylinder block, top cover and bottom tray and covers for these is considered particularly important, the other features, too, of the invention help to achieve the aim of longer operation time between faults and longer operating intervals between maintenance actions.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
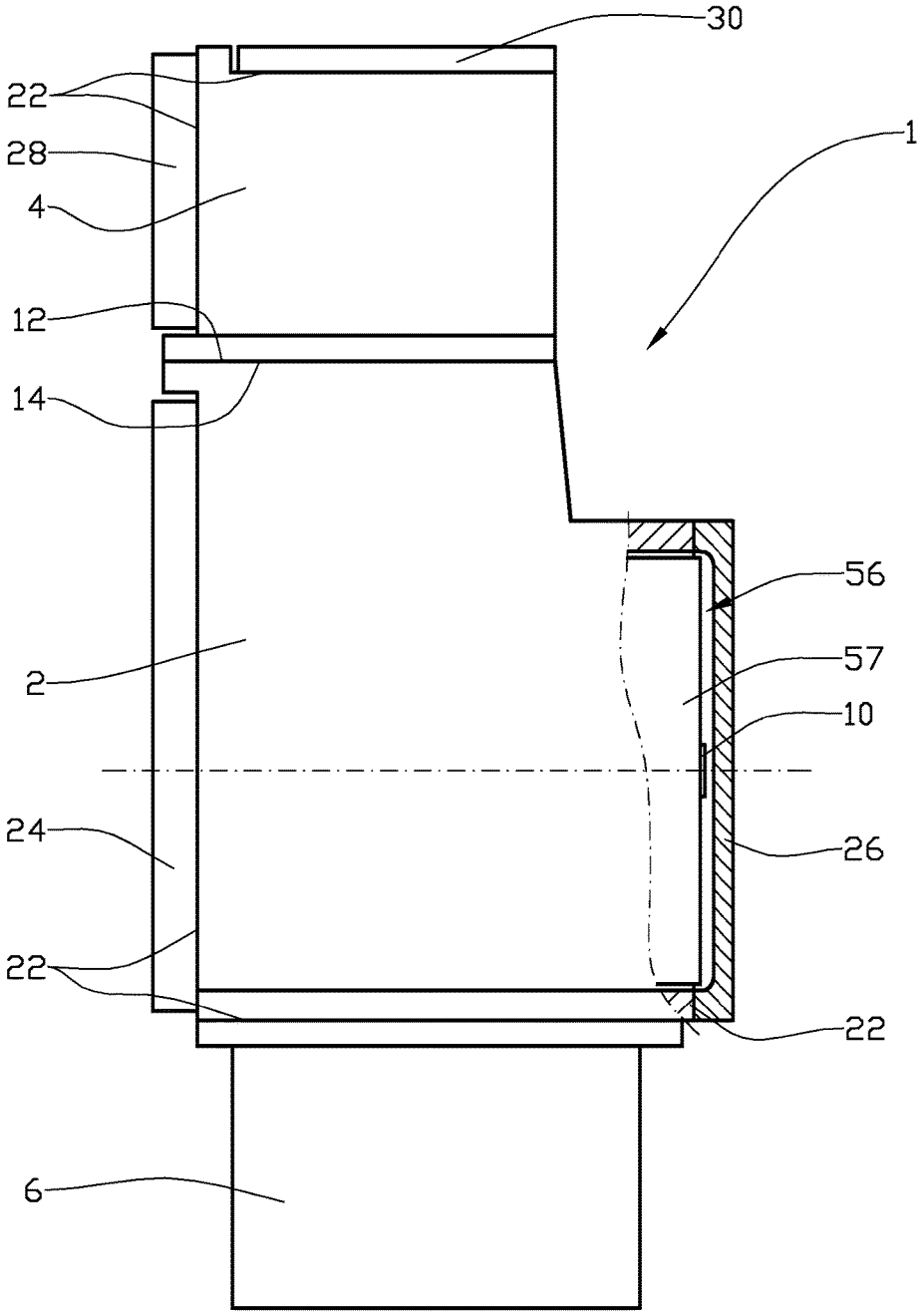
FIG. 1 shows a simplified side view of an external-heat engine according to the invention.

In the drawings, the reference numeral 1 indicates an external-heat engine, which includes a cylinder block 2, a top cover 4 and a bottom tray 6.

Figure 2:
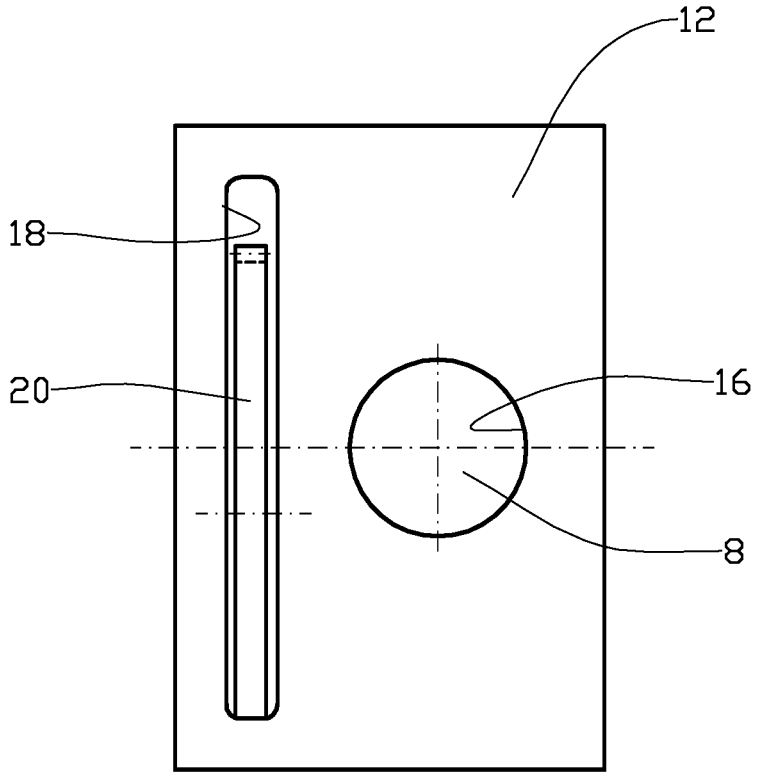
FIG. 2 shows the sealing surface of the cylinder block against the top cover in a simplified manner.

A piston 8, see FIG. 2, is connected to a crankshaft 10 (see FIG. 3) in a manner known per se.

The cylinder block 2 is formed with a first sealing surface 12 facing the top cover 4 and being arranged to rest sealingly against a second sealing surface 14 of the top cover 4.

FIG. 2 shows the first sealing surface 12, which has a piston opening 16 and a gear opening 18 for a first intermediate gear 20. Other openings necessary per se in the first sealing surface, such as bolt holes, are known to a person skilled in the art and are not shown.

The second sealing surface 14 is thus resting, typically via a top gasket not shown, against only the first sealing surface 12, which is complete; that is to say, there are no so-called T-joints, at which the end portion of a seal is typically perpendicular to a second seal, or other forms of combined sealing surfaces.

Correspondingly, sealing surfaces 22 of the cylinder block 2 seal against respective sealing surfaces of the bottom tray 6, of a timing-element cover 24 and of a generator cover 26.

The sealing surfaces 22 of the top cover seals in a corresponding manner against the sealing surface of a gear cover 28 and against a sealing surface of a valve cover 30.

Figure 3:
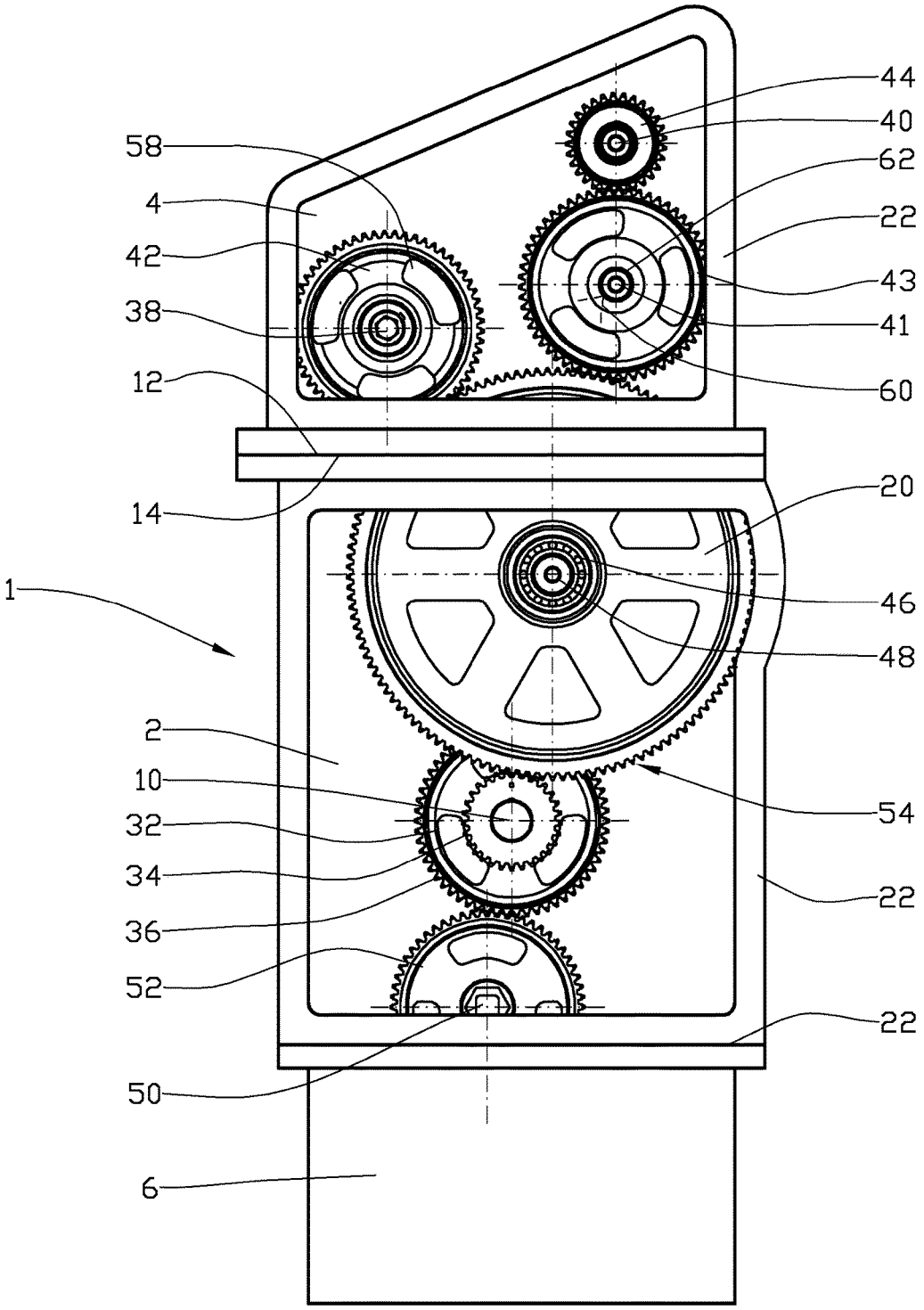
FIG. 3 shows an end view of the external-heat engine in a simplified manner, in which covers have been removed.

The crankshaft 10 is provided with a crankshaft gear 32 at one end portion (see FIG. 3). The crankshaft gear 32 is formed with a first set of teeth 34 and a second set of teeth 36. It is also obvious that said two sets of teeth 34, 36 may be parts of two gears separate per se.

In this preferred embodiment, the top cover 4 is formed with a rotary valve 38 on the inlet side and seat valves, not shown, on the outlet side, the seat valves being driven by a camshaft 40.

The rotary valve 38 and the camshaft 40 are driven by means of a first valve gear 42 and a second valve gear 44, respectively. The valve gears 42, 44 are driven via the first intermediate gear 20, which is in mesh with the first set of teeth 34 on the crankshaft gear 32, and a second intermediate gear 43 provides for further driving between the first intermediate gear 20 and the second valve gear 44. The ratios of the tooth numbers of the valve gears 42, 44 to the tooth number of the first set of teeth 34 are chosen to be such that the rotary valve 38 and the camshaft 40 are rotated at half speed and full speed, respectively, in relation to the crankshaft 10. The first intermediate gear 20 is supported in the cylinder block 2 by means of a bearing 46 sitting on a shaft 48.

A lubricant pump 50 is arranged in or at the bottom tray 6, and the lubricant pump 50 preferably consists of, among other things, a pump casing formed as part of the cylinder block 2. The lubricant pump 50 is driven by a pump gear 42 via the second set of teeth 36 on the crankshaft gear 32.

By letting both valve gears 42, 44 be driven by the first intermediate gear 20 and a second intermediate gear 43, respectively, the driving line 54 including the crankshaft gear 32, the first intermediate gear 20, the second intermediate gear 43 and the valve gears 42, 44 is substantially simplified. The solution makes it possible to dismantle the top cover 4 from the cylinder block 2 without dismantling the valve gear 42 and the second intermediate gear 43 from the top cover 4 or the intermediate gear 20 from the cylinder block 2.

A generator 56 (see FIG. 1) is connected to the crankshaft 10 at the opposite end portion of the crankshaft 10 relative to the crankshaft gear 32. The generator 56 is inside the generator cover 26 in the cylinder block 2. The generator 56 includes a rotor 57, which is arranged on the crankshaft 10.

In this preferred embodiment, a valve-actuating mechanism 58 is arranged between the first valve gear 42 and the rotary valve 38. Examples of valve-actuating mechanisms are given in the general part of the document.

A lubricant supply with a spreader 60 is arranged at a gear bearing 62. The crankshaft 10, rotary valve 38, camshaft 40, shafts 41, 48 and lubricant pump 50 constitute gear bearings 62 as they each hold a respective gear, the crankshaft gear 32, the first valve gear 42, the second valve gear 44, the intermediate gears 20, 43 and the pump gear 52, respectively.

Figure 4:
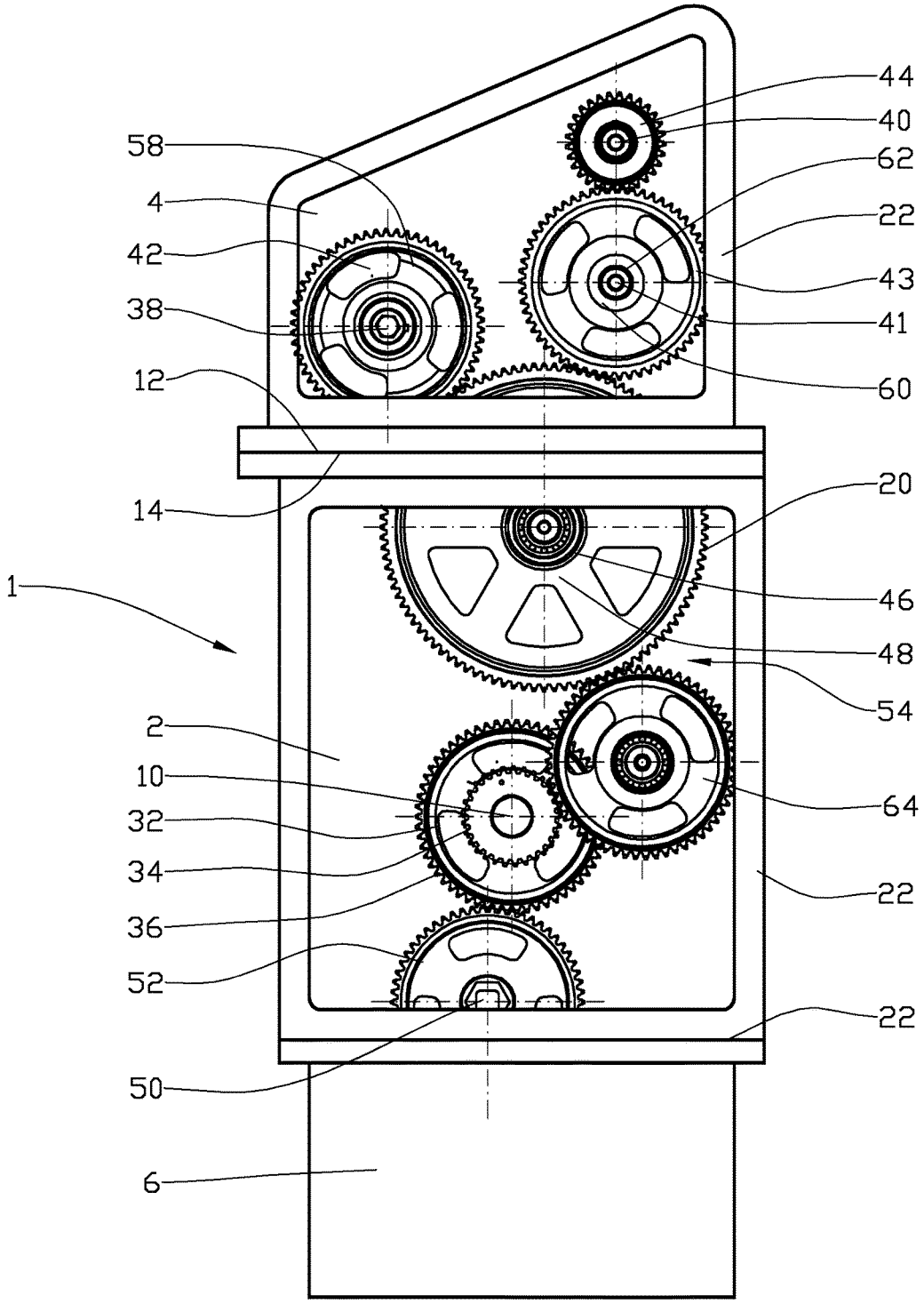
FIG. 4 shows the same as FIG. 3, but in an alternative embodiment.

In an alternative embodiment, see FIG. 4, the first intermediate gear 20 is driven by the first set of teeth 34 on the crankshaft gear 32 via a third intermediate gear 64.

This embodiment may be practical if the distance between the crankshaft gear 32 and the valve gears 42, 44 is large. A sufficiently large, single first intermediate gear 20 may then be impractical.

The invention claimed is:

1. An external-heat engine of a piston type working on a Rankine cycle, the external-heat engine comprising a cylinder block, a cylinder head and an oil sump with sealing surfaces arranged to be joined together and to rest against complementarily fitting covers, each sealing surface being arranged to rest sealingly against only one opposite sealing surface, wherein a first valve gear and a second valve gear are arranged in the cylinder head, a first intermediate gear being arranged to engage with the second valve gear via a second intermediate gear.

2. The external-heat engine according to claim 1, wherein the first intermediate gear is arranged to engage with a crankshaft gear.

3. The external-heat engine according to claim 2, wherein the first intermediate gear is engaged with said crankshaft gear via a third intermediate gear.

4. The external-heat engine according to claim 1, wherein at least one of the valve gears is connected to a camshaft.

5. The external-heat engine according to claim 1, wherein at least one of the valve gears is connected to a rotary valve.

6. The external-heat engine according to claim 1, wherein at least one of the valve gears is connected to a valve-actuating mechanism.

7. The external-heat engine claim 1, wherein said external-heat engine is pressurized and arranged to be pressure-tight towards the surroundings.

8. The external-heat engine according to claim 7, wherein said external-heat engine is dimensioned to resist an overpressure of at least 5 bar.

9. The external-heat engine according to claim 7, wherein a generator is located inside the pressure-tight external-heat engine.

10. The external-heat engine according to claim 1, wherein lubrication channels are provided in a shaft spreader, arranged for supply of lubricant to a gear bearing.

* * * * *